US005941049A

United States Patent [19]

Lancaster, III et al.

[11] Patent Number: 5,941,049

[45] Date of Patent: Aug. 24, 1999

[54] METHOD AND APPARATUS FOR STRETCH WRAPPING A LOAD

[75] Inventors: Patrick R. Lancaster, III, Louisville, Ky.; Curtis Martin, Floyds Knobs; Steven E. Degrasse, New Albany, both of Ind.

[73] Assignee: Lantech, Inc., Louisville, Ky.

[21] Appl. No.: 08/826,748

[22] Filed: Mar. 24, 1997

[51] Int. Cl.[6] ..... B65B 13/04

[52] U.S. Cl. ..... 53/399; 53/587

[58] Field of Search ..... 53/399, 556, 587, 53/588, 211

[56] References Cited

U.S. PATENT DOCUMENTS 4,972,656 11/1990 Haugstad ..... 53/211 X 5,005,335 4/1991 Yourgalite et al. ..... 53/587 X 5,168,691 12/1992 Errani ..... 53/587

5,564,258 10/1996 Jones et al. ..... 53/587 X

*Primary Examiner*—L. B. Johnson

*Attorney, Agent, or Firm*—Finnegan, Henderson, Farabow, Garrett & Dunner, L.L.P.

[57] ABSTRACT

A leading end of packaging materials placed in a retainer to hold the leading end of the packaging material in the retainer. Packaging material is dispensed from a packaging material dispenser, and relative rotation is provided between the dispenser and a load to wrap packaging material around the load. The packaging material is automatically released from the retainer in response to force applied by packaging material wrapped around the load, or other unpowered actuation.

22 Claims, 9 Drawing Sheets

METHOD AND APPARATUS FOR STRETCH WRAPPING A LOAD

BACKGROUND OF THE INVENTION

The invention relates to wrapping a load with packaging material. Loads have been stretch wrapped with stretch wrap packaging material by dispensing the packaging material, securing a leading end of the packaging material to the load or a turntable clamp, and providing relative rotation between the load and a packaging material dispenser. The relative rotation can be provided several different ways. Either the load can be rotated on a turntable, or the dispenser can be rotated around the stationary load. Stretch wrapping usually employs a web of stretch film as the packaging material.

Semi-automatic stretch wrapping machinery requires the operator to attach a leading end of the packaging material to the load. This is typically accomplished by forming a rope in the leading end of the film and then inserting this end between the layers of the load or tying the end of the packaging material to the edge of the supporting wood pallet or any suitable outcropping on the load. This attachment must be relatively strong since it provides the resistance to pulling the film from the film dispenser during the initiation of the relative rotation between the load and the film dispenser. The attachment or tying of the film makes film removal more difficult after the load has been shipped to its destination.

Automatic stretch wrapping machinery use film clamps that typically grip the film web between two opposed surfaces and use electrical or pneumatic actuators to open and close the clamps. When a turntable is used to rotate the load, it is necessary to establish a rotating journal for electrical or pneumatic connections. Such connections add to space and cost requirements.

Hooks and wedge-type clamps have been attempted in the past but leave the leading end of film tail unsecured by an overwrap of film. These tails are easily snagged by fork trucks or other rack storage systems and can increase the risk of damage to the film overwrap and its ability to contain the load.

In light of these drawbacks, there is a need for a method and apparatus for wrapping a load with packaging material that operates as effectively as those previously developed but which can be manufactured at a lower cost.

SUMMARY OF THE INVENTION

Accordingly, the present invention is directed to a method and apparatus for wrapping a load with packaging material which provides advantages and obviates a number of problems in earlier methods and apparatus for wrapping a load.

To achieve these and other advantages and in accordance with the purpose of the invention, as embodied and broadly described, the invention includes an apparatus for wrapping a load of packaging material including a dispenser for dispensing packaging material, means for providing relative rotation between the dispenser and the load to wrap packaging material around the load, and a retainer for holding a leading end of the packaging material while initially wrapping the load.

According to one aspect of the invention, the retainer automatically releases the packaging material in response to unpowered actuation. According to another aspect of the invention, the retainer automatically releases the packaging material in response to force applied by packaging material wrapped around the load.

According to another aspect of the invention, the retainer includes a gripper for holding the packaging material between opposed surfaces and moves from a radially outward position to a radially inward position to release the packaging material.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENTS

Figure 1:
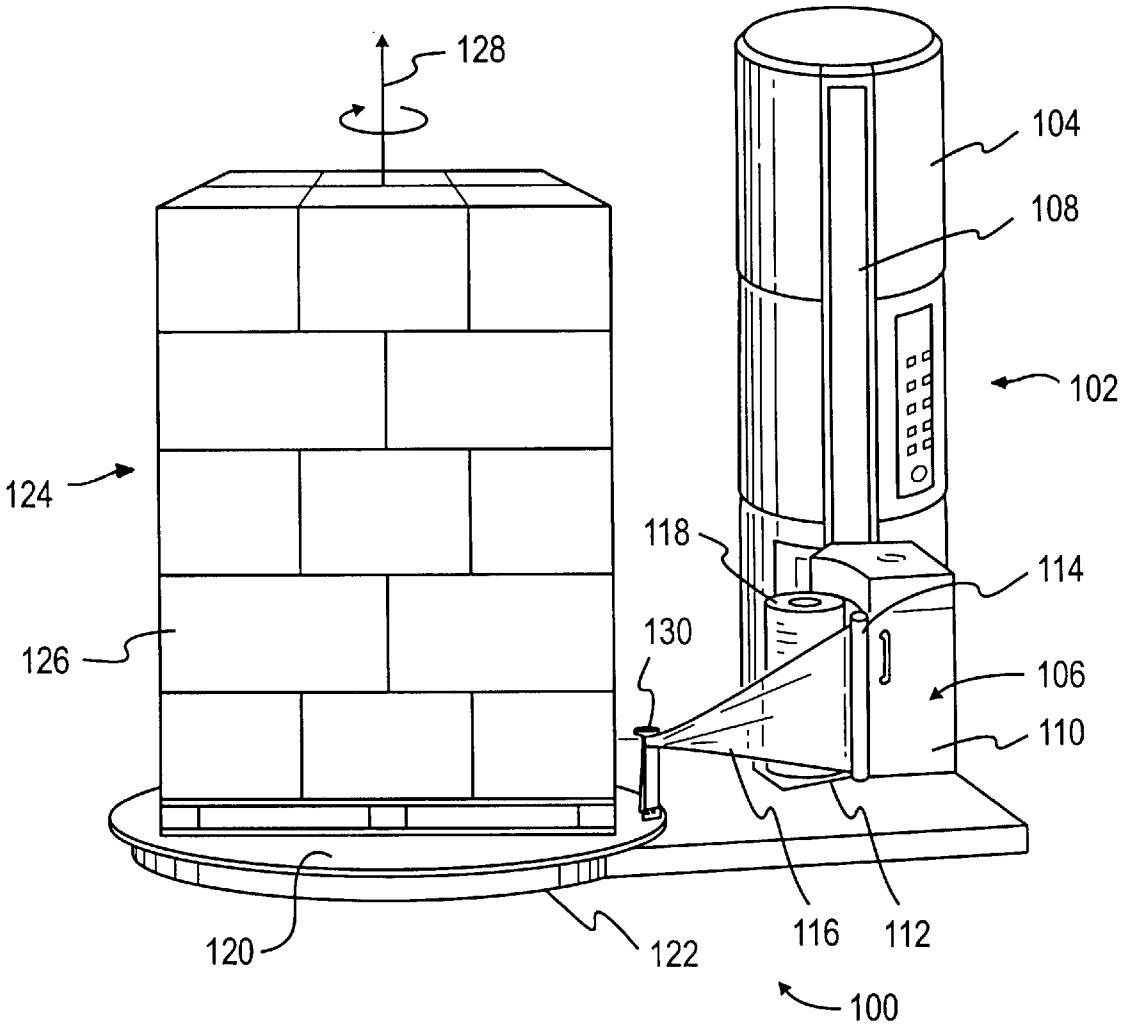
FIG. 1 is a perspective view of a stretch wrap packaging machine according to the teachings of the present invention.

According to the invention, an apparatus is provided for wrapping a load with packaging material. As shown in FIG. 1, the apparatus for wrapping a load with packaging material includes stretch wrapping apparatus 100.

According to the present invention, a dispenser is provided for dispensing and stretching packaging material. As shown in FIG. 1, the dispenser includes stretch wrap dispenser 102, including a mast 104, a roll carriage 106, and a belt and motor drive 108 for vertically positioning roll dispenser 106 on mast 104 to spirally wrap the load. Roll carriage 106 may include a frame 110, a film roll support 112 and a variety of rollers 114, possibly including prestretch rollers, to position, dispense, and stretch a packaging material such a stretch wrap film 116 being dispensed from stretch wrap film roll 118. Various other packaging materials such as netting, strapping, banding, or tape can be used as well.

According to the present invention, the apparatus includes means for providing relative rotation between the dispenser and the load to wrap packaging material around the load. As shown in FIG. 1, the means for providing relative rotation includes a motor driven turntable 120 mounted on base 122 to rotate load 124 of load units 126 about a vertical axis 128.

Alternatively, the means for providing relative rotation between the dispenser and the load may include an arrangement in which the film dispenser revolves around the load, so that the dispenser may be carried by a ring or arm or other arrangement. The relative rotation may occur about a vertical axis as shown for pallet loads, or may occur around a horizontal axis for bundling operations.

According to one aspect of the invention, a retainer is provided for holding a leading end of the packaging material while initially wrapping the load, and for automatically releasing the packaging material in response to unpowered actuation.

As shown in FIG. 1, the retainer includes a gripper clamp 130, which is shown in more detail by FIGS. 2 through 5. Gripper clamp 130 can be seen to include an elongated member such as tube 132 having a top plate 133 welded to one end of tube 132 to form one jaw 134, and a rod 131 slidable within tube 132 and welded to a second plate 135 to form a second jaw 136 such that jaws 134 and 136 have opposing surfaces that can clamp packaging material between them and prevent movement of the packaging material relative to the jaws.

Figure 3:
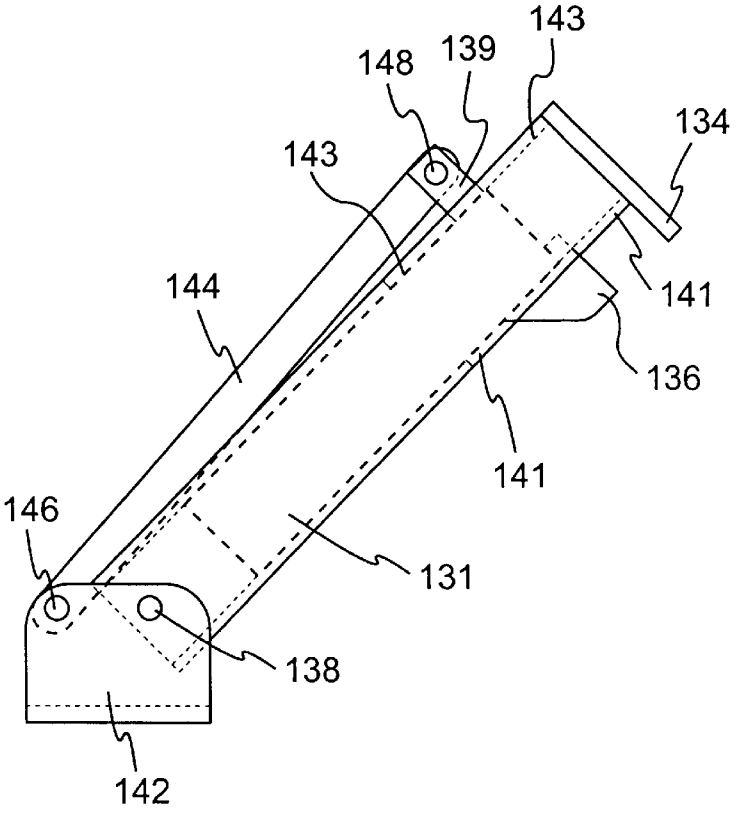
FIG. 3 is a cross sectional view of the retainer of FIG. 2 shown in a different position.
Figure 2:
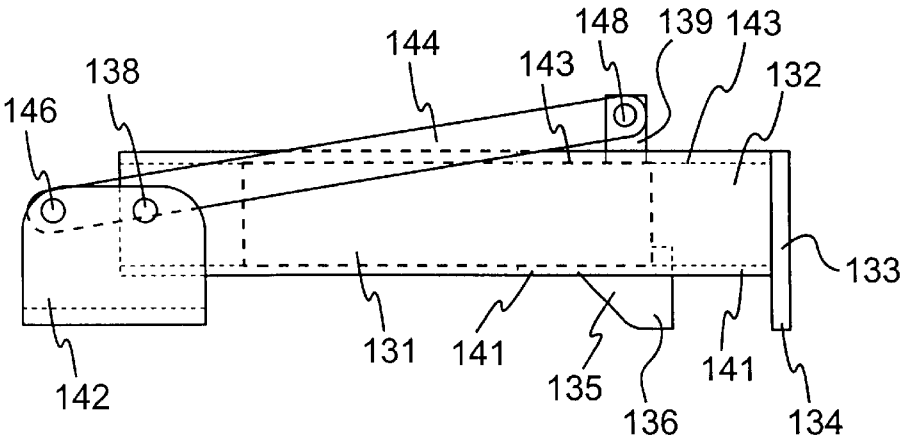
FIG. 2 is a cross sectional view of a retainer used in the stretch wrapping machine of FIG. 1.
Figure 5:
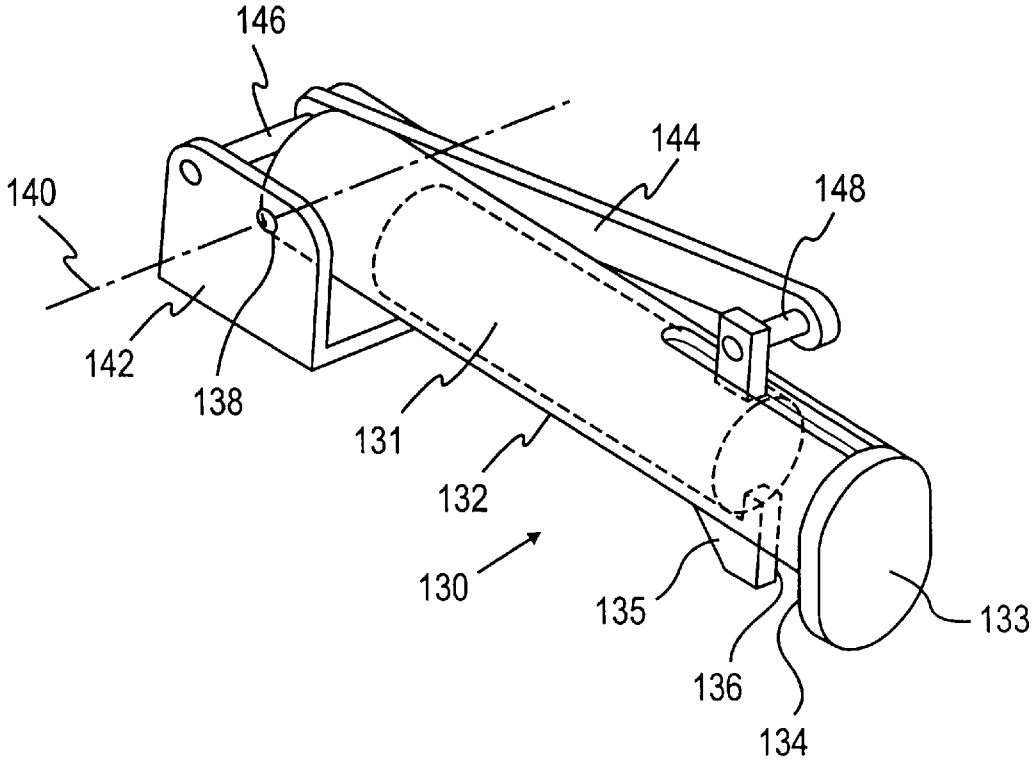
FIG. 5 is a perspective view in partial cross section of the retainer of FIG. 2.
Figure 4:
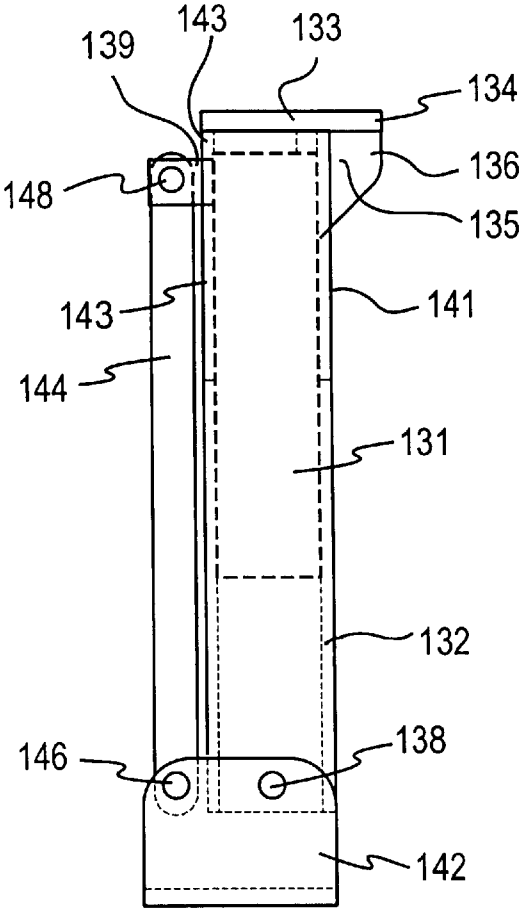
FIG. 4 is a cross sectional view of the retainer of FIG. 2 in yet another position.

Tube 132 has a pivot 138 such as a pin or bolt, with a pivot axis 140, permitting tube 132 to pivot relative to base 142 between the generally horizontal position shown in FIG. 2, with jaws 134 and 136 in the open position, through an intermediate position shown in FIG. 3, to the generally vertical position shown in FIG. 4, with the jaws 134 and 136 in a closed position.

Jaw 136 is moved between the open position of FIG. 2 and the closed position of FIG. 4 by a linkage 144 that pivots about a pin 146 in base 142, and a pin 148 in mounting plate 139, which is welded to rod 131 and jaw 136. Tube 132 includes a first laterally extending slot 141 through which plate 135 extends and moves, and a second laterally extending slot 143 through which mounting plate 139 extends and moves.

Figure 6:
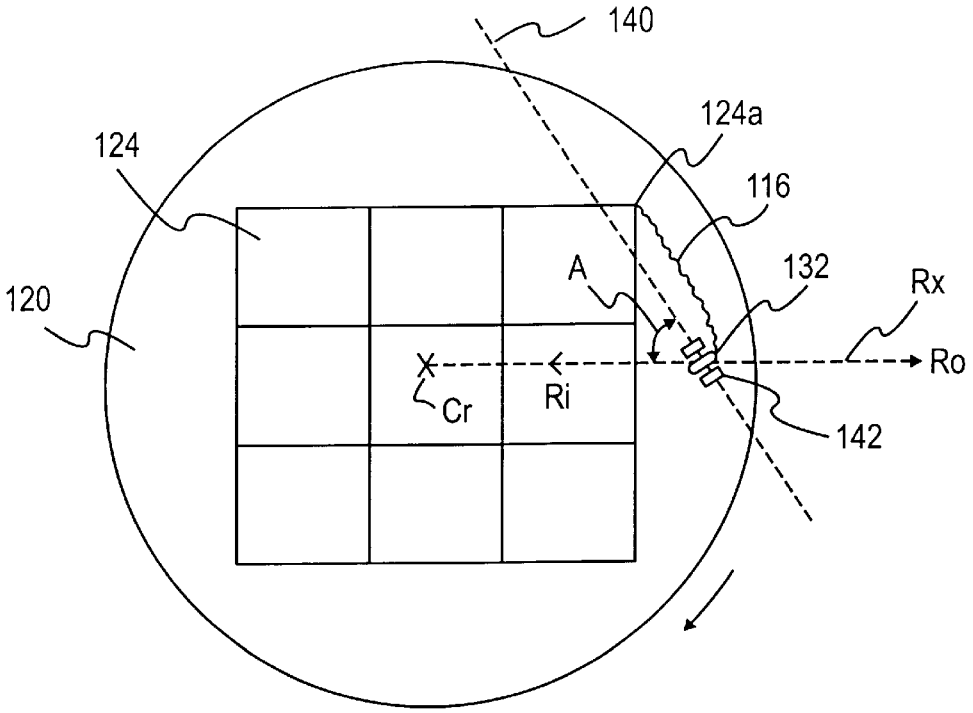
FIG. 6 is a schematic top view of a portion of the stretch wrapping of FIG. 1.

FIG. 6 shows the top view of turntable 120 with the load 124 and retainer 130. In this arrangement, turntable 120 rotates clockwise in the direction of the arrow and is used to define a general coordinate system where radially outward, $R_O$, is in a direction generally radially outward from the center of relative rotation $C_r$ of turntable 120 and radially inward, $R_j$, is used to denote a direction generally radially inward toward the center of rotation $C_r$.

As can be seen from the figures, the retainer 130 pivots from a radially outward position to a radially inward position to release the packaging material.

As shown in FIG. 6, the pivot axis 140 of the retainer 130 passes radially inward of a point where the load 124 is first contacted by the packaging material 116, namely the point defined by edge 124*a* of the load. This orientation is preferable to prevent the packaging material 116 from pulling retainer 130 radially inward and being inadvertently released from retainer 130 before packaging material 116 is wrapped around the load.

As shown in FIG. 6, it is currently most preferable that the pivot axis 140 of the retainer 130 angles from a radial $R_x$ inward toward the load where the load is first contacted by the packaging material, namely edge 124*a*. It is further preferable for the angle to be at an angle A of approximately 70–80 degrees from a radial $R_x$.

Figure 7:
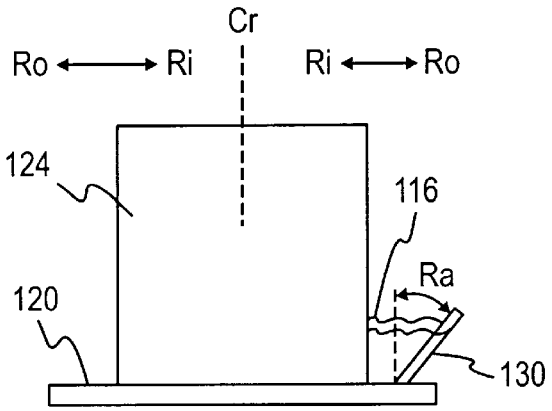
FIG. 7 is a schematic side view of FIG. 6.

As shown in FIG. 7, it is preferable for desirable holding and release characteristics in this embodiment of the invention for the retainer 130 to angle radially outward when holding the packaging material. It is currently most preferable for this arrangement for the retainer to angle radially outward at an angle $R_a$ of approximately 10 to 17 degrees from a vertical line passing through pivot axis 140 when holding the packaging material. It is further preferable that the retainer angles radially outward when releasing the packaging material, thereby releasing the packaging material before the retainer angles radially inward.

Figure 8:
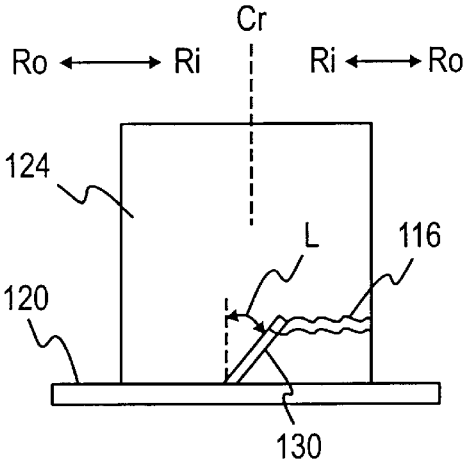
FIG. 8 is a schematic view of a second side of the arrangement of FIG. 6.

As shown in FIG. 8, it is preferable for desirable holding and release characteristics in this embodiment for the retainer 130 to angle laterally toward the direction the packaging material 116 is wrapped around the load, in this figure, to the right. In this embodiment, it is preferable for the retainer to angle laterally at an angle L of approximately 12 to 17 degrees from a vertical line passing through the pivot axis 140.

While these specified orientations are currently preferable for the preferred embodiment, other orientations may also be used.

Figure 9A:
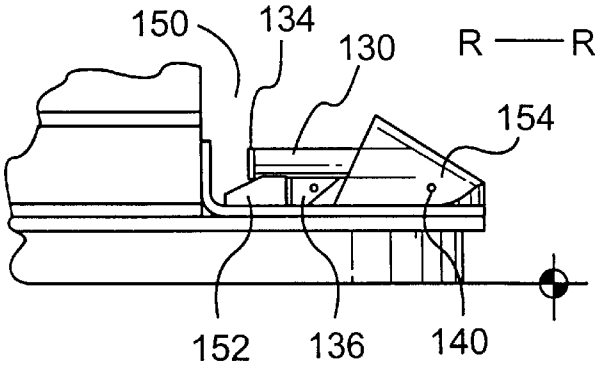
FIG. 9*a* is a side view of a portion of FIG. 9.
Figure 9:
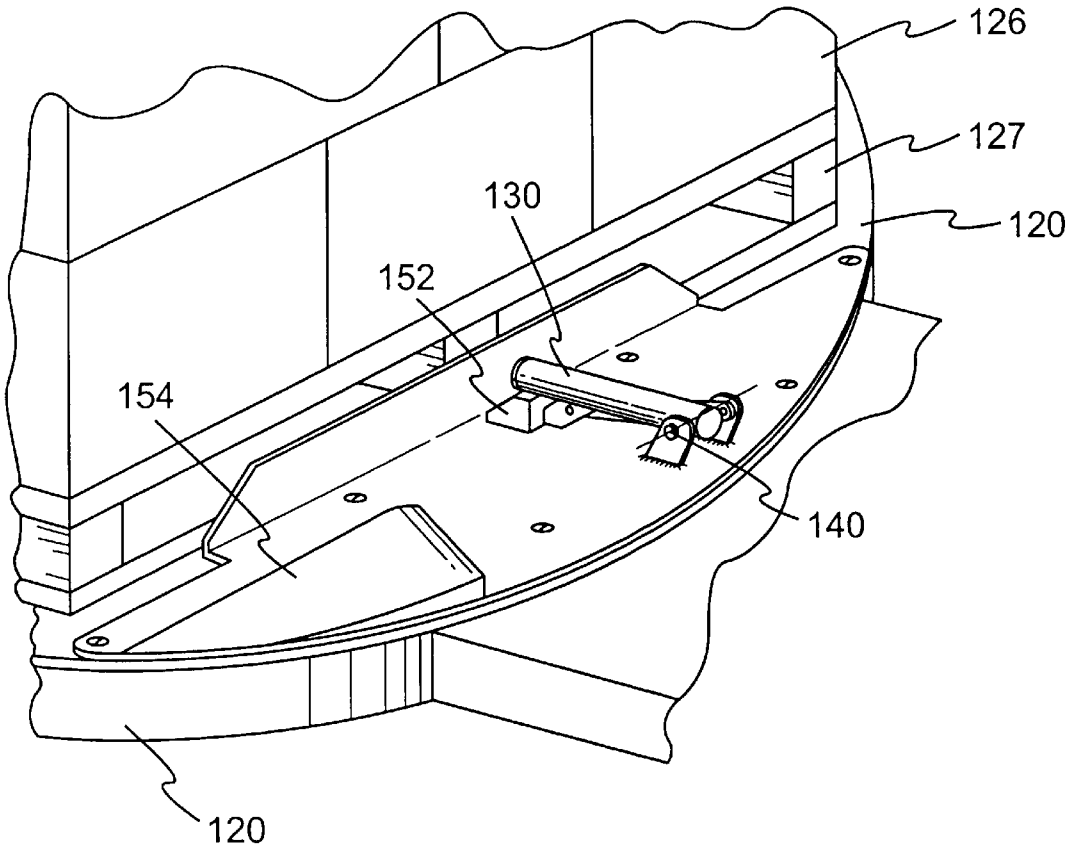
FIG. 9 is a detailed perspective view of a portion of the arrangement of FIG. 1 with the retainer in another position.
Figure 10A:
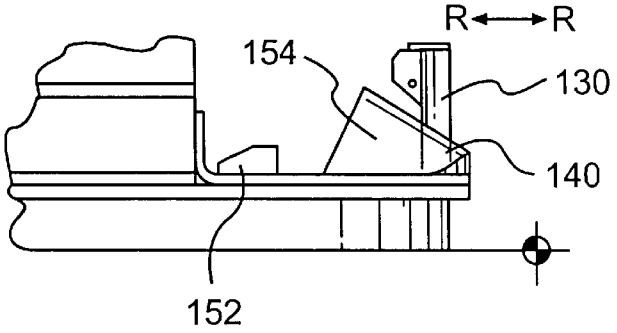
FIG. 10*a* is a side view of a portion of the arrangement of FIG. 10.
Figure 10:
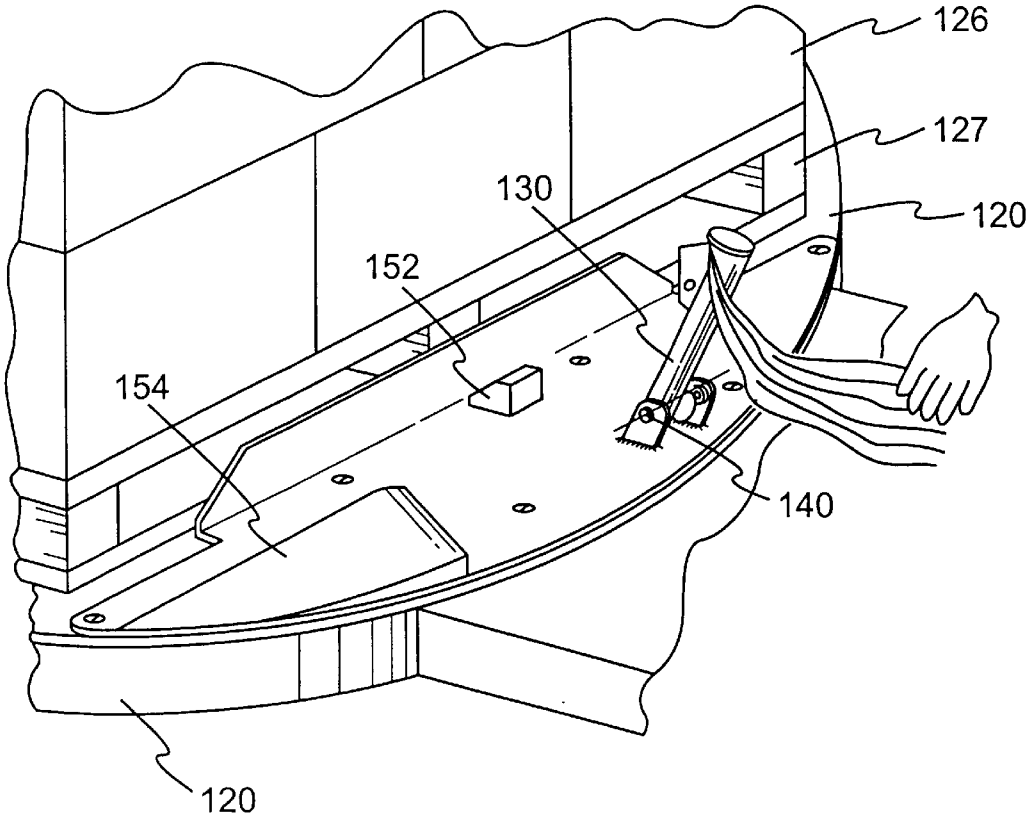
FIG. 10 is a perspective view of the arrangement of FIG. 9 with the retainer in another position with stretch wrap packaging material placed in the retainer.
Figure 11:
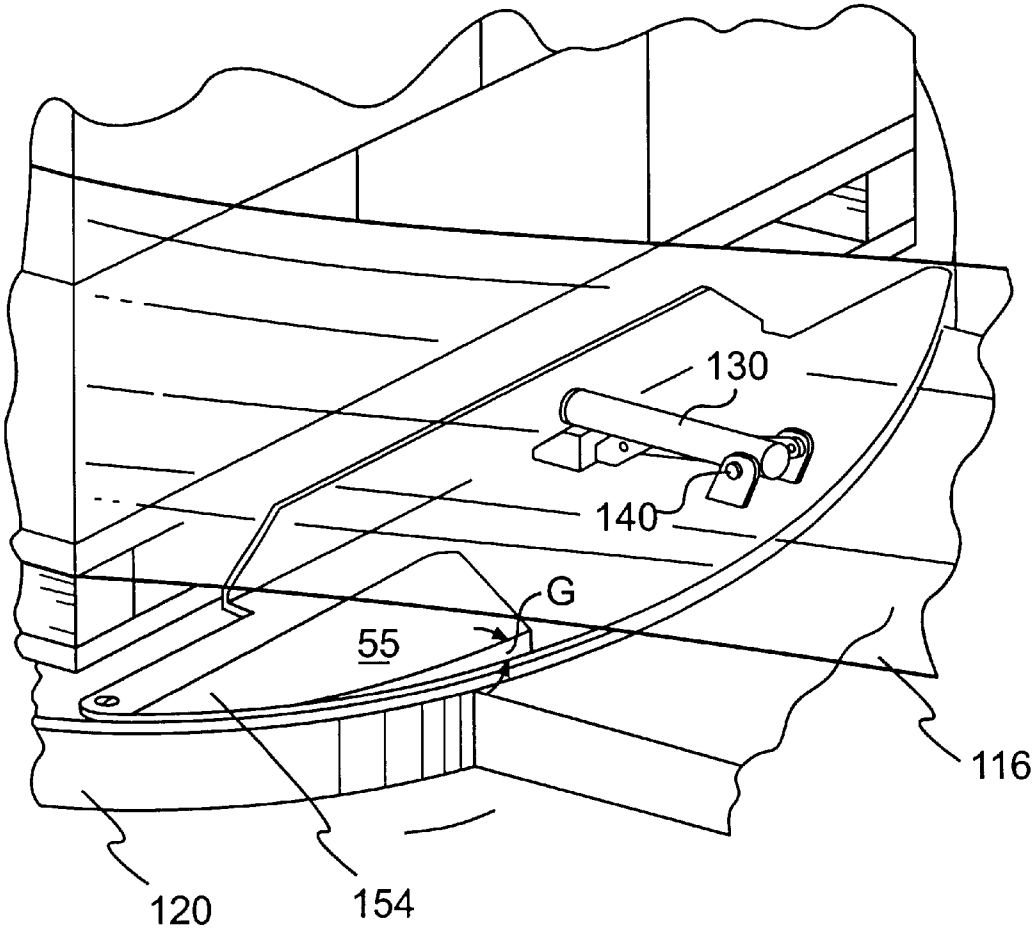
FIG. 11 is a perspective view of the arrangement of FIG. 9 during wrapping.

FIGS. 9 through 11 show load 126 on a wooden pallet 127 on top of turntable 120. In particular, FIGS. 9 and 10 respectively show retainer 130 in a radially inward open position ready for receiving a leading end of packaging material, and a radially outward closed position.

As shown in FIG. 9*a*, the leading end of the packaging material may be manually placed in the retainer 130 at the beginning of a wrap cycle by placing it in the loading area 150 radially inward of retainer 130 and pulling the packaging material in the radially outward direction Ro so that the packaging material slides between guard 152 and retainer 130 until it is between jaws 134 and 136. By pulling radially outward on both ends of a segment of packaging material, the packaging material will pull retainer 130 from the radially inward and open position shown in FIG. 9*a* to the radially outward and closed position shown in FIG. 10*a* thereby holding the leading end of the packaging material securely in the retainer 130. Guard 152 is a block that prevents the retainer from engaging an operator's fingers in the horizontal position. The resulting clamped packaging material is shown in FIG. 10.

A guide 154 is stationed on turntable 120 for positioning the packaging material above the pivot axis 140 of the retainer 130 when the load is being wrapped with packaging material, thereby permitting the packaging material to apply its force solely above the pivot axis 140 and thereby automatically release the packaging material more easily than if the packaging material applied force both above and below pivot axis 140. FIG. 11 shows how guide 154 includes a ramp 55 at an angle G, preferably not exceeding about 40 degrees, that ramps packaging material 116 up above pivot axis 140 as the load is wrapped.

While it is currently preferable for the retainer to use a gripper for holding the packaging material with opposing surfaces, various other retainers may be used and still be within the scope of the invention. For example, the retainer may include a rod having a holding surface, such as a tacky, sticky, quilled, or fish scale surface. The holding portion may be a longitudinal strip on one side of the rod, and the packaging material may be released by rotating the rod as it is moved inward. A pull off or push off device may be used to assist in releasing the film from the holding surface or other retainer.

In operation, the method and apparatus make the following steps as shown in FIGS. 1 and 12 through 15. To reach the starting position shown in FIG. 1, the load 124 is placed onto the turntable 120 by a roller conveyor or forklift truck, and a leading end of the packaging material 116 is manually placed in the retainer 130 to hold the leading end of the packaging material in the retainer 130, moving the retainer 130 from a horizontal to a vertical position, as discussed previously.

Figure 12:
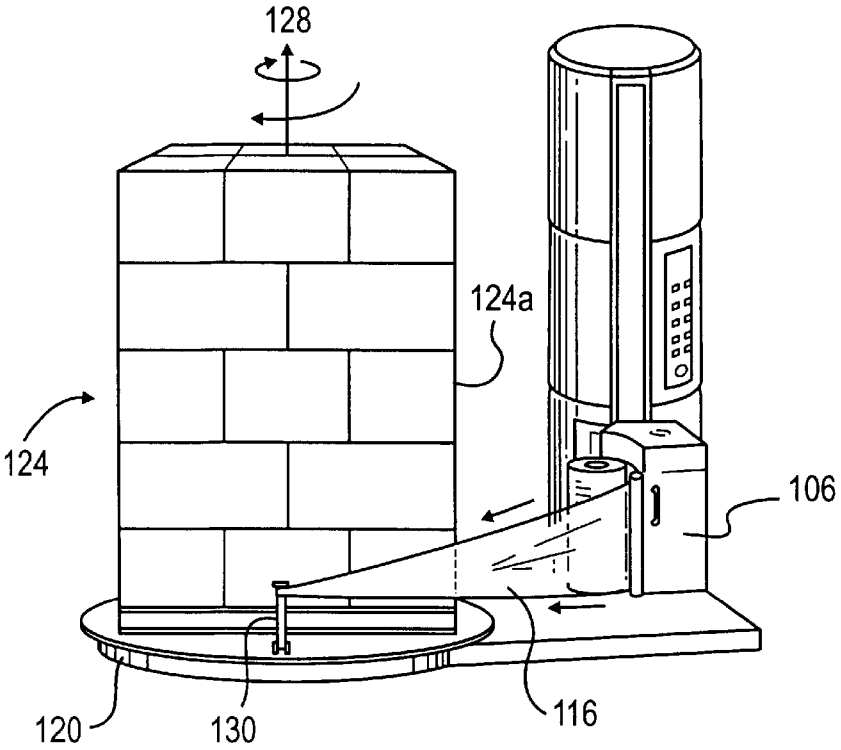
FIG. 12 is a perspective of the arrangement shown in FIG. 1 at a later point in the wrapping cycle.

As shown in FIG. 12, the motor-driven turntable 120 begins to rotate about axis 128 in a clockwise direction as the retainer 130 holds the packaging material 116. Packaging material 116 is preferably oriented to pass through jaws of retainer 130 from right to left and then around the left side and back of retainer 130 rather than merely being clamped in retainer 130 and passing through the jaws of the clamp from left to right. In addition, it is generally preferable to collapse the leading end of the packaging material into a rope when manually placing it in the jaws of retainer 130.

Figure 13:
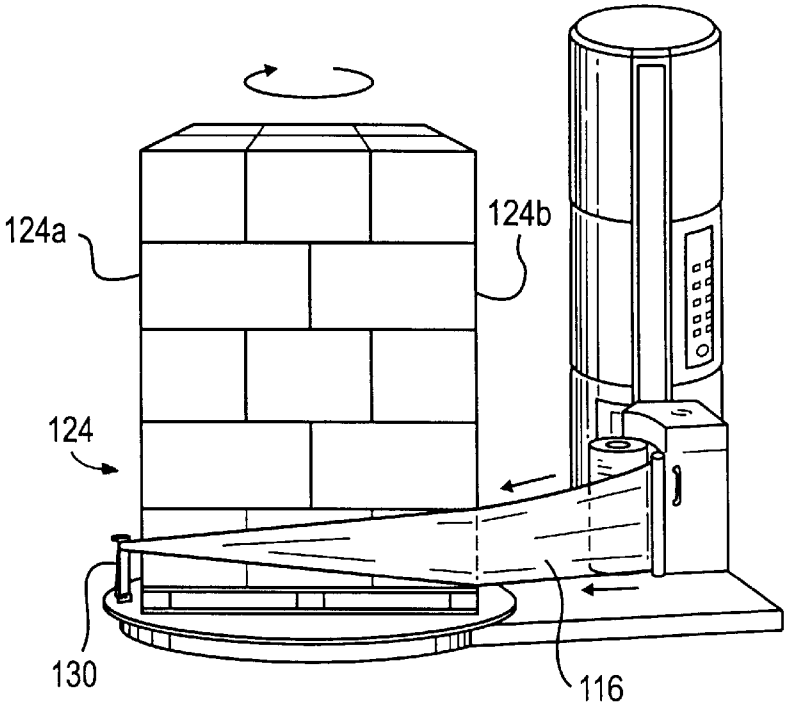
FIG. 13 is a perspective of the arrangement shown in FIG. 12 at a later point in the wrapping cycle.

As turntable 120 rotates, packaging material dispenser 106 stretches and dispenses packaging material 116 which first engages edge 124*a* of load 124 and subsequently, in FIG. 13, engages the second edge 124*b* of load 124 while retainer 130 continues to hold the leading end of the packaging material 116. The packaging material begins to expand further from its roped arrangement to a full-width web. The wrapping then continues as the third side of the load 124 is wrapped and the packaging material engages the third edge 124*c* of load 124 while retainer 130 still holds the leading end of the packaging material.

Figure 14:
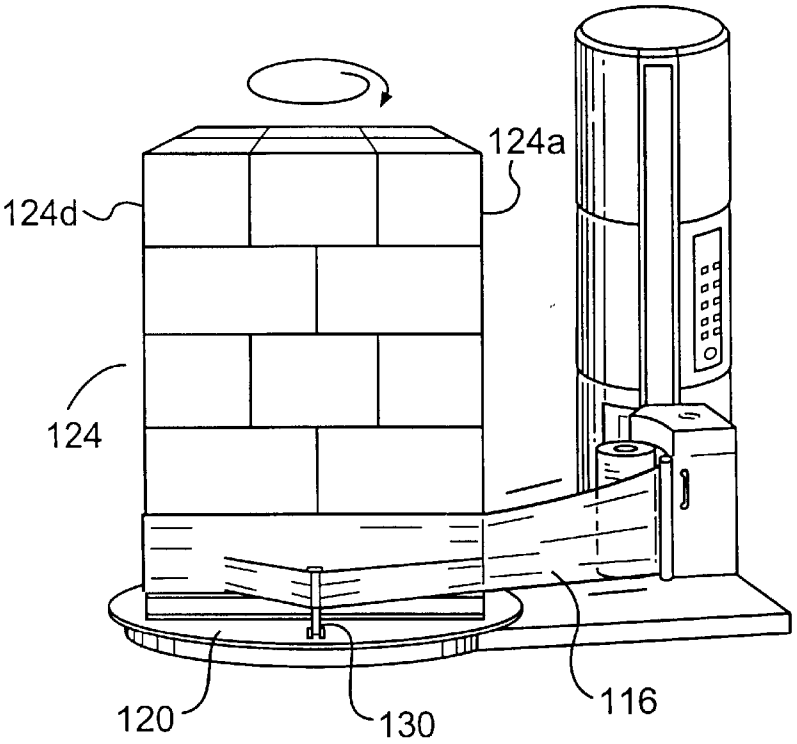
FIG. 14 is a perspective of the arrangement shown in FIG. 13 at a later point in the wrapping cycle.

In FIG. 14, the packaging material has wrapped around the fourth edge 124*d* of load 124 and retainer 130 and turntable 120 continue to rotate so that retainer 130 is overwrapped by packaging material 116. A resultant force is applied radially inward to the retainer 130 by the packaging material 116 wrapped on the radially outward side of retainer 130, urging the retainer 130 to move radially inward.

Figure 15:
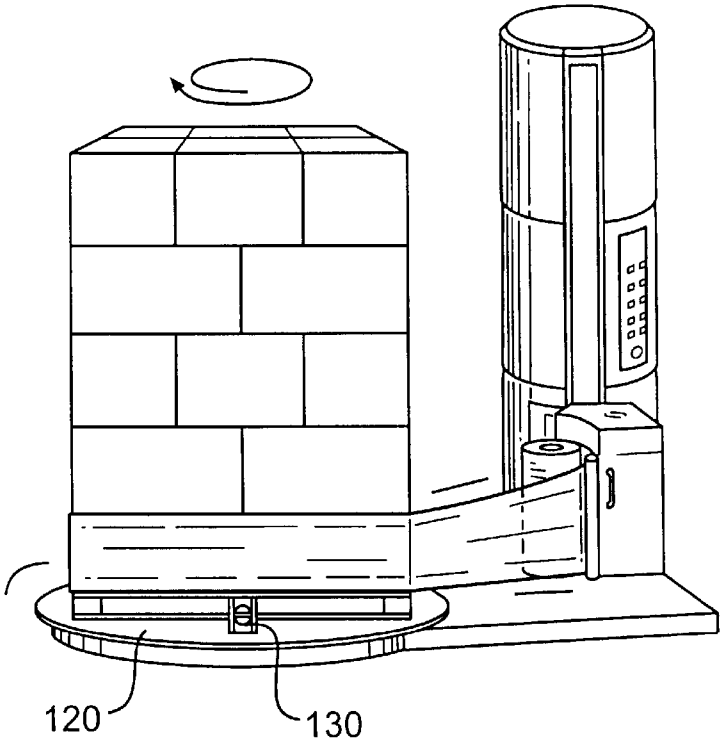
FIG. 15 is a perspective of the arrangement shown in FIG. 14 at a later point in the wrapping cycle.

At some point, either with one wrap or with the cumulative force of more than one wrap on the outside of the retainer, the retainer is forced to move and collapse radially inward and automatically release the packaging material held in its jaws. The overwrapped film captures the leading end of the film and holds it against the load. FIG. 15 shows the end result of the collapsed retainer and released leading end of the film web.

While it is preferable to automatically release the packaging material in response to force applied by packaging material wrapped around the load, it is also within the scope of the invention to automatically release the packaging material in response to other unpowered actuation. Such unpowered actuation involves the absence of any electrical or pneumatic connection to the retainer to actuate the retainer. It may include, for example, a cam that engages and moves the retainer at a desirable point for release during the rotation of the turntable or dispenser. It also may include, for example, a linkage between the retainer and the load which moves the retainer and releases the film in response to moving or raising the wrapped load from the wrapping area.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

What is claimed is:

1. An apparatus for wrapping a load with packaging material comprising:

a dispenser for dispensing and stretching packaging material;

means for providing relative rotation between the dispenser and the load to wrap stretched packaging material around the load; and a retainer for holding a leading end of the packaging material while initially wrapping the load, and for automatically releasing the packaging material in response to force applied to a portion of the retainer by packaging material wrapped around the load.

2. The apparatus of claim 1, wherein the retainer includes a gripper for holding the packaging material between opposed surfaces.

3. The apparatus of claim 2, wherein the means for providing relative rotation defines a relative center of rotation and the retainer moves from a radially outward position to a radially inward position with respect to the relative center of rotation to release the packaging material.

4. The apparatus of claim 2, wherein the retainer includes a pivot with a pivot axis, the means for providing relative rotation defines a relative center of rotation, and the retainer moves from a radially outward position to a radially inward position about the pivot axis with respect to the relative center of rotation to release the packaging material.

5. The apparatus of claim 4, wherein the pivot axis of the retainer passes radially inward with respect to the relative center of rotation of a point where the load is first contacted by the packaging material.

6. The apparatus of claim 4 wherein the pivot axis of the retainer angles, from a radial extending from the relative center of rotation, inward toward the load where the load is first contacted by the packaging material.

7. The apparatus of claim 6 wherein the pivot axis of the retainer angles from the radial approximately 70–80 degrees.

8. The apparatus of claim 2, wherein the means for providing relative rotation defines a relative center of rotation and the retainer angles radially outward with respect to the relative center of rotation when holding the packaging material.

9. The apparatus of claim 8, wherein the retainer angles radially outward approximately 10–17 degrees with respect to the relative center of rotation from a vertical line passing through a pivot axis of the retainer when holding the packaging material.

10. The apparatus of claim 8, wherein the retainer angles radially outward with respect to the relative center of rotation when releasing the packaging material.

11. The apparatus of claim 2, wherein the means for providing relative rotation defines a relative center of rotation and the retainer angles laterally with respect to the relative center of rotation from a vertical line passing through a pivot axis of the retainer toward the direction the packaging material is wrapped around the load when holding the packaging material.

12. The apparatus of claim 11, wherein the retainer angles laterally approximately 12–17 degrees when holding the packaging material.

13. The apparatus of claim 2, wherein the means for providing relative rotation includes a rotatable turntable for supporting the load and the retainer is mounted on the rotatable turntable to rotate with the turntable.

14. The apparatus of claim 2, wherein the retainer includes an elongated member movable from a generally horizontal position for receiving the packaging material to a generally vertical position for holding the packaging material.

15. The apparatus of claim 14, including a guard for preventing the retainer from engaging an operators fingers when the retainer is in the horizontal position.

16. The apparatus of claim 4, including a guide for positioning the packaging material above the pivot axis of the retainer when the load is being wrapped with the packaging material.

17. The apparatus of claim 16 wherein the guide includes a ramp for positioning the packaging material.

18. The apparatus of claim 17 wherein the ramp is disposed at an angle not exceeding about 40 degrees.

19. A method for wrapping a load with packaging material comprising:

placing a leading end of the packaging material in a retainer to hold the leading end of the packaging material in the retainer;

dispensing the packaging material from a packaging material dispenser and providing relative rotation between the dispenser and the load to wrap the packaging material around the load; and automatically releasing the packaging material from the retainer in response to force applied to a portion of the retainer by the packaging material wrapped around the load.

20. The method of claim 19, wherein the placing is performed manually.

21. The method of claim 19 including roping the leading end of the packaging material before the placing.

22. The method of claim 19 wherein the relative rotation defines a relative center of rotation and including drawing the retainer radially outward with respect to the relative center of rotation during the placing.

* * * * *

UNITED STATES PATENT AND TRADEMARK OFFICE

CERTIFICATE OF CORRECTION

PATENT NO. : 5,941,049
DATED : August 24, 1999
INVENTOR(S) : Patrick R. Lancaster, III; Curtis Martin; Steven E. Degrasse It is certified that error appears in the above-identified patent and that said Letters Patent is hereby corrected as shown below:

Claim 15, Column 7; line 18, change "operators" to --operator's--.

Signed and Sealed this

Sixth Day of June, 2000

*Attest:*

Q. TODD DICKINSON

*Attesting Officer*

*Director of Patents and Trademarks*